United States Patent [19]

Inagaki et al.

[11] Patent Number: 4,686,945

[45] Date of Patent: Aug. 18, 1987

[54] VALVE STRUCTURE FOR AN INTERNAL COMBUSTION ENGINE

[75] Inventors: Takashi Inagaki; Shinichi Nakano, both of Saitama, Japan

[73] Assignee: Honda Giken Kogyo Kabushiki Kaisha, Tokyo, Japan

[21] Appl. No.: 794,588

[22] Filed: Nov. 4, 1985

Related U.S. Application Data

[63] Continuation of Ser. No. 545,667, Oct. 26, 1983, abandoned.

[30] Foreign Application Priority Data

Oct. 26, 1982 [JP] Japan ..... 57-163013

[51] Int. Cl.[4] ..... F01L 1/18

[52] U.S. Cl. ..... 123/90.22; 123/90.27; 123/90.44

[58] Field of Search ..... 123/90.22, 90.27, 90.39, 123/90.44, 90.41

[56] References Cited

U.S. PATENT DOCUMENTS

| | | | |
|---|---|---|---|
| 1,411,208 | 3/1922 | Elliott et al. | 123/90.27 X |
| 1,459,630 | 6/1923 | Lonzerotti - spina | 123/90.27 X |
| 1,633,882 | 6/1927 | Ballot | 123/90.27 X |
| 3,299,871 | 1/1967 | Apfelbeck | 123/90.27 |
| 3,722,484 | 3/1973 | Gordini | 123/90.27 |
| 4,414,931 | 11/1983 | Burandt | 123/90.44 X |

FOREIGN PATENT DOCUMENTS

| | | | |
|---|---|---|---|
| 1203538 | 2/1959 | Fed. Rep. of Germany | 123/90.27 |
| 2739132 | 3/1979 | Fed. Rep. of Germany | 123/90.27 |

*Primary Examiner*—William R. Cline
*Assistant Examiner*—Peggy Neils
*Attorney, Agent, or Firm*—Lyon & Lyon

[57] ABSTRACT

An engine employing multiple valves which are mutually inclined. A valve actuating assembly includes two camshafts. Primary rocker arms are driven by the camshafts and in turn drive secondary rocker arms. The secondary rocker arms are pivotally mounted about common shafts and extend to the valves. The common shafts are located between the valves.

5 Claims, 5 Drawing Figures

VALVE STRUCTURE FOR AN INTERNAL COMBUSTION ENGINE

This application is a continuation of application Ser. No. 545,667, filed 10/26/1983, now abandoned.

BACKGROUND OF THE INVENTION

The field of the present invention is valve actuating systems for the valves of an internal combustion engine particularly employing multiple intake or exhaust valves.

With modern internal combustion engines, multiple valves for each of the intake and exhaust systems have been employed as a means for improving engine efficiency. Additionally, it is often found that the contour of the combustion chamber head is such that the valves are inclined relative to one another if the valve stem is to be aligned with the local normal of the surface. Under such conditions, the mechanisms necessary for actuating the valves can become very complicated. Two prior art devices illustrating substantial complication in valve actuating structure are shown in FIGS. 4 and 5. In FIG. 4, a pair of valves 10 are illustrated as being driven by secondary rocker arms 12 which are pivotally mounted to two shafts 14. The shafts 14 extend outwardly from the location of the valve 10 as can best be seen in the Figure. The secondary rocker arms 12 are in turn driven by primary rocker arms 16 which are in turn driven by camshafts 18. This system suffers from undue complication because of the multiple shafts 14 and the multiple camshafts 18. Additionally, the extension of the shafts 14 outwardly from the valves requires substantial room adding significantly to the overall profile of the head structure.

In the prior art illustration of FIG. 5, an improved arrangement is illustrated. Two valves 20 are driven by secondary rocker arms 22. The secondary rocker arms 22 are in turn associated with primary rocker arms 24 driven by a camshaft 26. Through the location of the second rocker arms 22 between the valves 20 as can best be seen in FIG. 5, a single camshaft 26 may be employed. However, the extension of these rocker arms 22 inwardly between the valves 20 generally necessitates a compromise in valve angle and/or in head width so as to accommodate the appropriate mechanism. Additionally, two shafts (not shown) are required for the secondary rocker arms 22. Lastly, the compromise necessary for appropriate valve orientation limits the length of the secondary rocker arms 22. Thus, substantial complexity and a compromise in design have generally been required of multiple valve systems with mutually inclined valves.

SUMMARY OF THE INVENTION

The present invention relates to an improved assembly for actuating multiple valves associated with an internal combustion engine where the valves are mutually inclined. To this end, primary rocker arms may be driven from a single camshaft and in turn drive secondary rocker arms which extend from a common shaft between the valves to actuate each valve. The location and mounting of the secondary rocker arms enables the valves to be properly oriented relative to the combustion chamber without increasing the size of the head and employing unnecessary additional complexity. Valve efficiency is thereby improved without compromise in the overall engine design.

Accordingly, it is an object of the present invention to provide an improved valve assembly for an internal combustion engine. Other and further objects and advantages will appear hereinafter.

DETAILED DESCRIPTION OF THE PREFERRED EMBODIMENT

Figure 1:
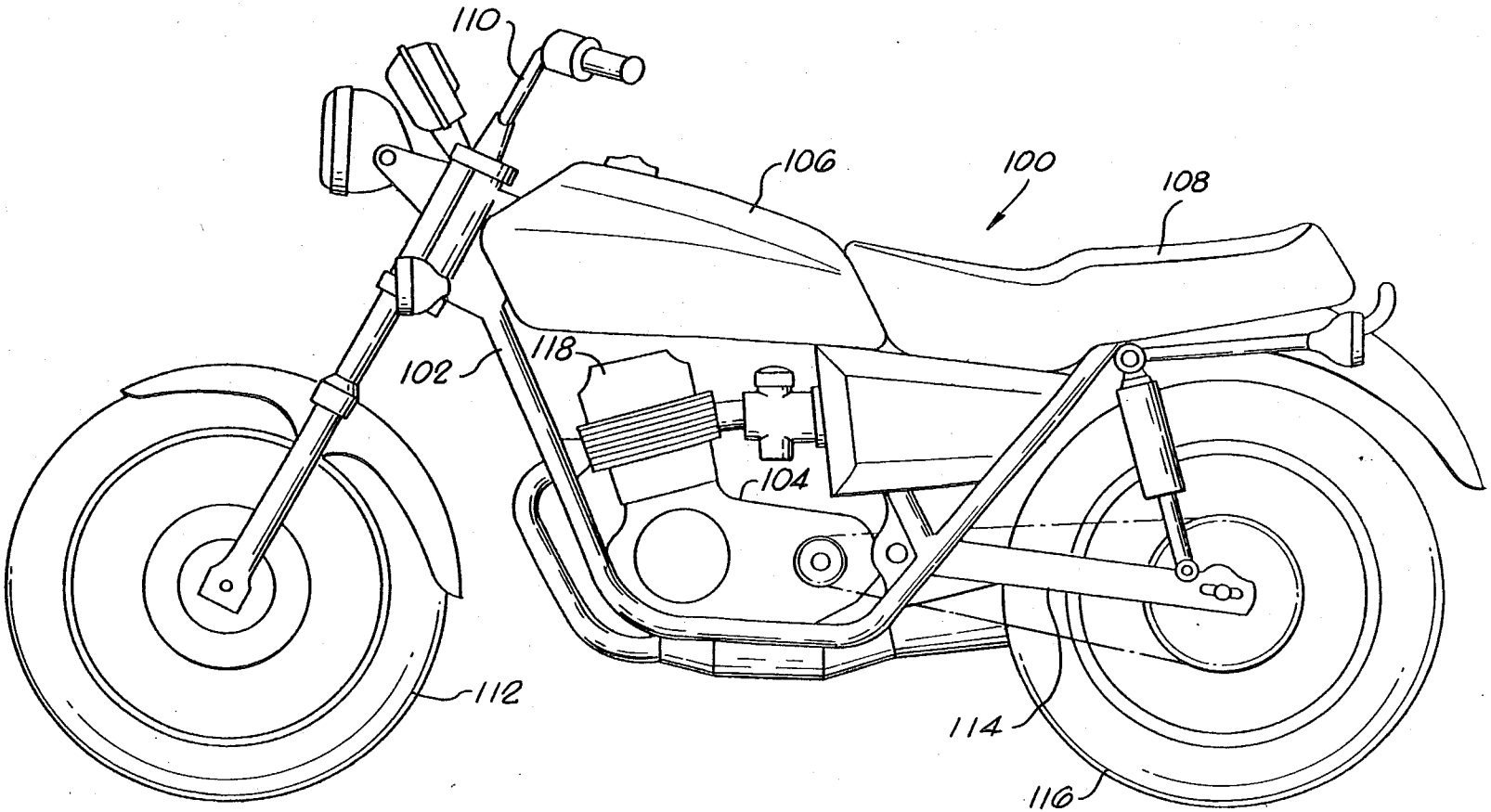
FIG. 1 is a side view of a motorcycle which may incorporate an engine employing the present invention.

Turning in detail to the drawings, a motorcycle 100 is illustrated in FIG. 1 which may employ an engine incorporating the present invention. The motorcycle includes a frame 102 within which is mounted an engine 104. The engine 104 is located below a fuel tank 106 in a space provided within the frame 102. A seat 108 is supported on the frame 102 behind the fuel tank 106. The frame extends to a front suspension and steering assembly 110 which mounts a front wheel 112. A rear suspension assembly 114 includes a rear wheel 116. As can be seen in FIG. 1, the engine head 118 is generally located in an area of limited space. Consequently, it is advantageous to employ as small a head structure and valve assembly as possible to reduce the overall motorcycle size.

Figure 2:
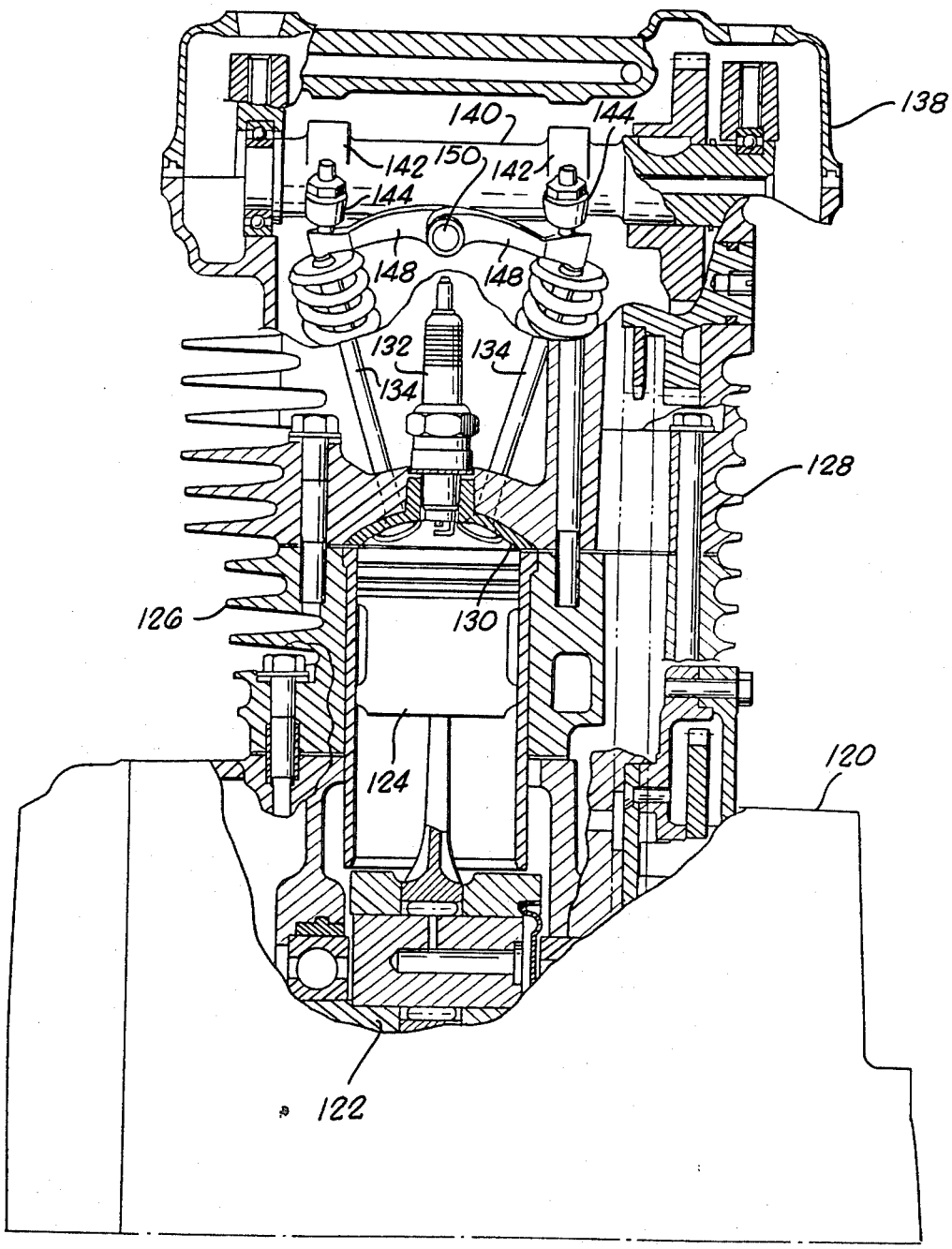
FIG. 2 is a cross-sectional elevation of an engine employing the present invention.
Figure 3:
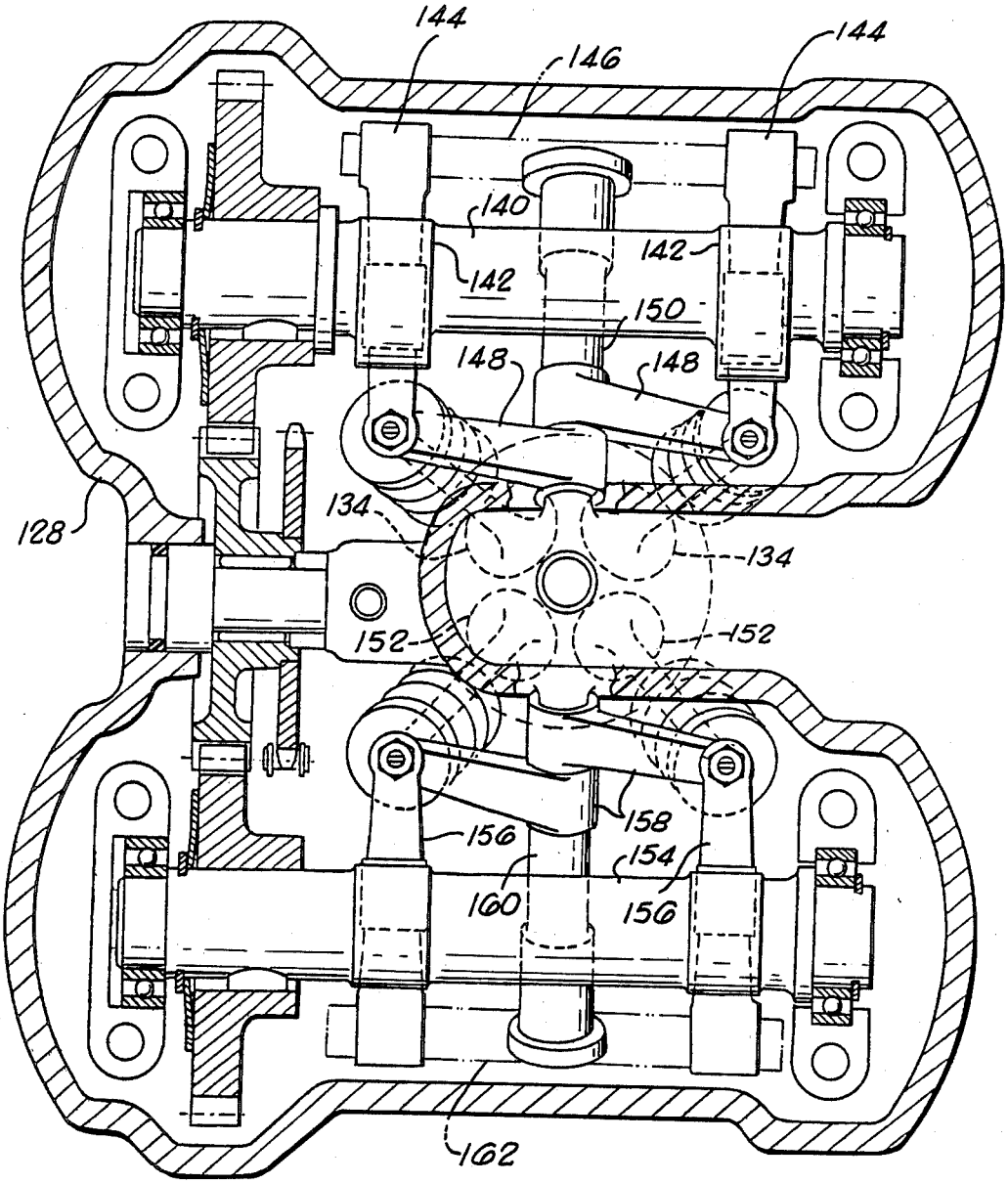
FIG. 3 is a cross-sectional plan view illustrating the valve actuating mechanism of the present invention.
Figure 4:
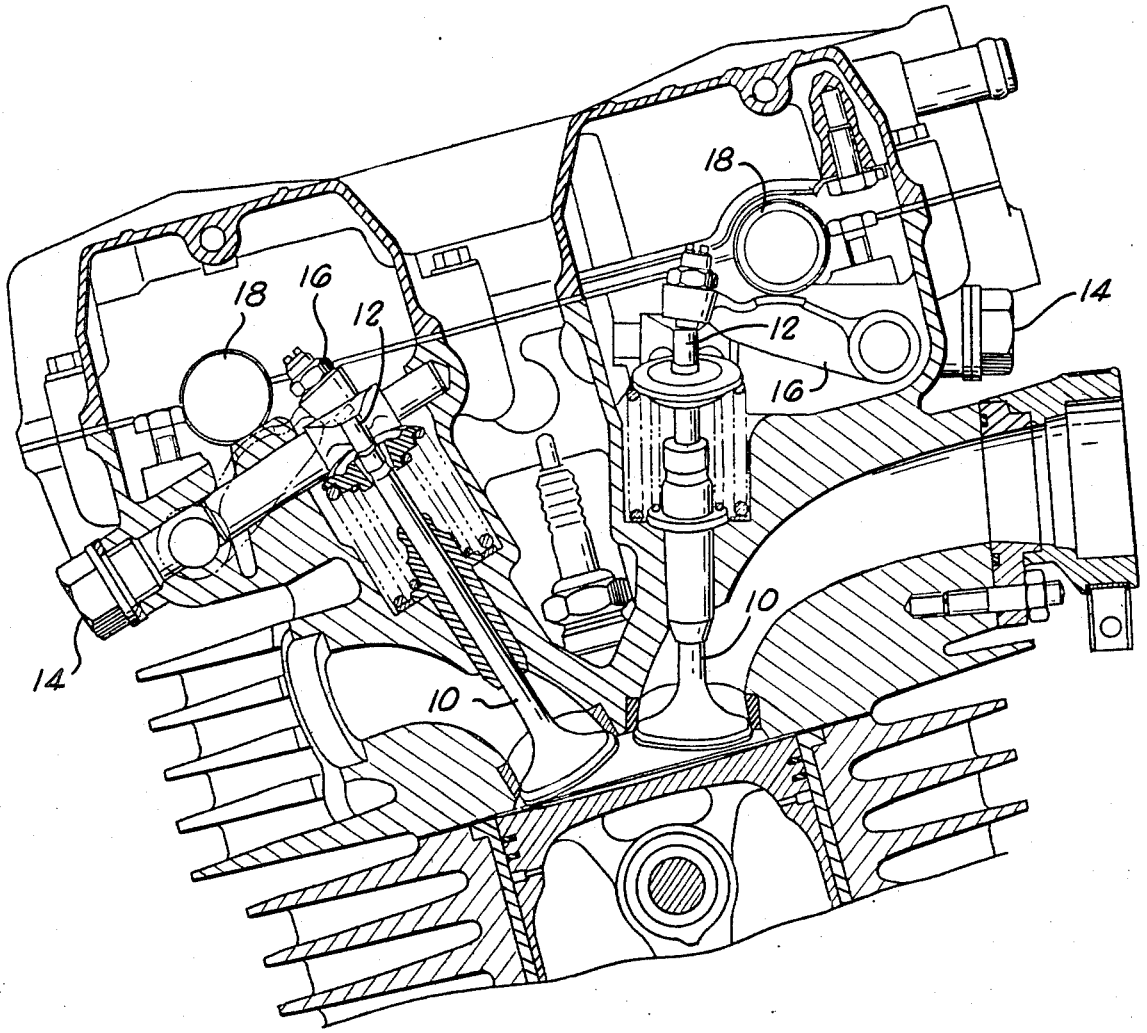
FIG. 4. PRIOR ART
FIG. 4 is a cross-sectional elevation of a prior art valve actuating arrangement.
Figure 5:
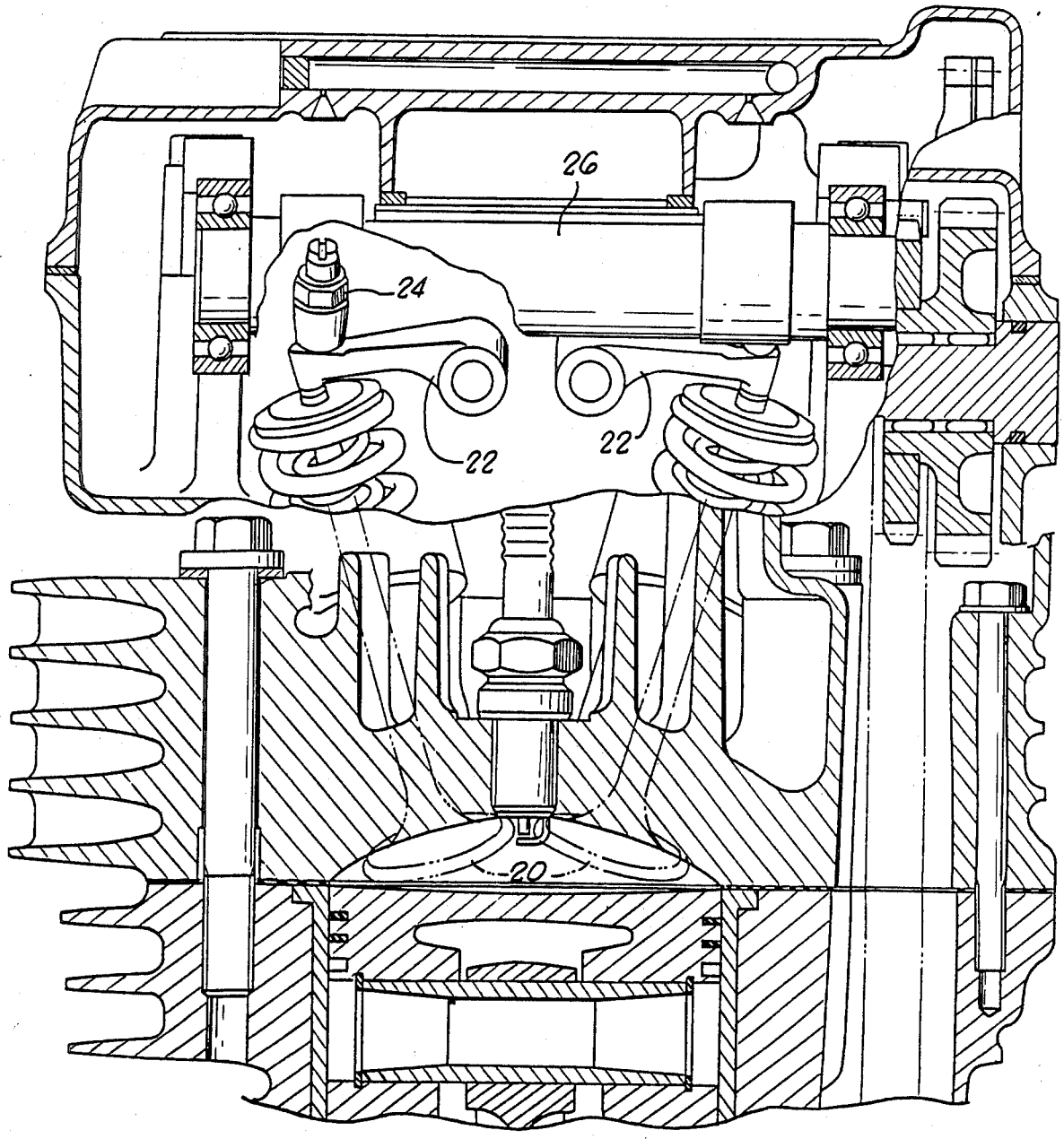
FIG. 5. PRIOR ART
FIG. 5 is a cross-sectional elevation of another prior art valve actuating mechanism.

Looking to the valve assembly of FIGS. 2 and 3, a crankcase 120 is shown to include a crankshaft 122. Associated with the crankshaft 122 is a piston 124 extending into a cylinder within a cylinder block 126. Mounted on the cylinder block 126 is a cylinder head 128 defining a combustion chamber ceiling 130. The combustion chamber ceiling 130 is rounded in profile as can best be seen in FIG. 2. An ignition plug 132, two intake valves 134 and two exhaust valves 136 (illustrated in FIG. 3) extend into the combustion chamber and are supported by the cylinder head 128. A cylinder head cover 138 covers the mechanism associated with the cylinder head 128.

Located within the cylinder head cover 138 and appropriately mounted relative to the cylinder head 128 is a valve actuating assembly, which, combined with the valves 134 and 136, form the valve assembly. A camshaft 140 including cams 142 is rotatably mounted in the head 128. Pivotally fixed in the head 128 so as to be biased against the cams 142 and activated thereby are primary rocker arms 144. These rocker arms 144 are mounted about a shaft 146. The shaft 146 is mounted generally parallel to the cam shaft 140 such that sliding between the primary rocker arms 144 and the cams 142 occurs in only one direction.

The primary rocker arms 144 extend to secondary rocker arms 148. The secondary rocker arms 148 are pivotally mounted about a common shaft 150 located between the valves 134 as can best be seen in FIG. 2. The secondary rocker arms 148 extend to the ends of the valve stems of the valves 134 for actuation thereof. The shaft 150 may be generally inclined to reduce to a minimum the horizontal components of driving pressure on the valve. Additionally, the inclination adds to a smooth and accurate valve stroke. By extending the rocker arms 148 to the common shaft 150, extended stroke length is available without excessive sliding between the secondary rocker arms 148 and the ends of the valves 134.

Looking specifically to FIG. 3, a similar actuating assembly associated with two exhaust valves 152 is illustrated. A common camshaft 154 actuates the valves through two primary rocker arms 156 which in turn actuate two secondary rocker arms 158. The secondary rocker arms 158 are pivotally mounted about a common shaft 160 while the primary rocker arms are mounted about a common shaft 162.

Through the employment of the primary and secondary rocker arms as illustrated in the preferred embodiment, minimum lateral forces are imposed upon the valves, smooth and accurate strokes may be achieved and longer strokes are possible. At the same time, a relatively simple assembly is realized which is also compact in overall design. While embodiment and applications of this invention have been shown and described, it would be apparent to those skilled in the art that many more modifications are possible without departing from the invention concepts herein. The invention, therefore, is not to be restricted except in the spirit of the appended claims.

What is claimed is:

1. A valve assembly for an internal combustion engine including a combustion chamber having an axial centerline and a crankshaft having an axis perpendicular to the axial centerline of the combustion chamber, said valve assembly comprising two valves each inclined outwardly from the combustion chamber at about equiangular orientation to the axial centerline of the combustion chamber and being substantially symmetrically disposed to either side of a transverse plane perpendicular to the crankshaft and including the axial centerline;

a camshaft having a camshaft axis substantially parallel to the crankshaft;

a primary rocker arm for each of said valves, said rocker arms being pivotally mounted on a first common pivotal axis, said axis being substantially parallel to said camshaft, said rocker arms being biased against said camshaft;

a secondary rocker arm for each of said valves, said secondary rocker arms being mounted for pivoting about a second common pivotal axis, each said secondary rocker arm extending from said second pivotal axis to one of said valves and being driven by one of said primary rocker arms; and a mounting shaft oriented along said second common pivotal axis to which said secondary rocker arms pivot, said mounting shaft being located in the transverse plane, said secondary rocker arms extending outwardly from said mounting shaft in opposite directions.

2. A valve assembly for an internal combustion engine, including a combustion chamber having an axial centerline and a crankshaft having an axis perpendicular to the axial centerline of the combustion chamber, said valve assembly comprising two intake valves;

two exhaust valves;

two camshafts positioned parallel to the crankshaft and on opposite sides of the axial centerline, one of said camshafts being associated with said intake valves and the other of said camshafts being associated with said exhaust valves;

a primary rocker arm for each of said intake and exhaust valves, each of said rocker arms associated with said intake valves being pivotally mounted on a first common pivotal axis and each of said rocker arms associated with said exhaust valves being pivotally mounted on a second common pivotal axis, said axes being parallel to the camshafts and said primary rocker arms being biased against said camshafts;

a secondary rocker arm for each of said intake and exhaust valves, each of said secondary rocker arms for said intake valves being pivotally mounted at a common pivotal axis to extend to said valve and being driven by one of said primary rocker arms and each of said secondary rocker arms for said exhaust valves being pivotally mounted at a common pivotal axis to extend to said valve and being driven by the other of said primary rocker arms; and an intake mounting shaft for pivotally mounting both of said secondary rocker arms associated with said intake valves;

an exhaust mounting shaft for pivotally mounting both of said secondary rocker arms associated with said exhaust valves, said intake mounting shaft being located centered between said intake valves and said exhaust mounting shaft being located centered between said exhaust valves.

3. A valve assembly for an internal combustion engine, comprising:

two valves;

a camshaft;

a primary rocker arm for each of said valves, said primary rocker arms being pivotally mounted and biased against said camshaft;

a secondary rocker arm for each of said valves, said secondary rocker arms being mounted for pivoting about a common pivotal axis, each said secondary rocker arm extending to one of said valves and being driven by one of said primary rocker arms; and a mounting shaft oriented along said common pivotal axis to which said secondary rocker arms are mounted and about which said secondary rocker arms pivot, said mounting shaft being located between said valves and being located such that said common pivotal axis is substantially normal to said camshaft, said secondary rocker arms extending outwardly to either side of said mounting shaft.

4. A valve assembly for an internal combustion engine having a crankshaft, comprising two intake valves;

two exhaust valves;

an intake cam shaft positioned parallel to the crankshaft, said intake cam shaft being associated with said intake valves;

an exhaust cam shaft positioned parallel to the crankshaft, said exhaust cam shaft being associated with said exhaust valves;

an intake valve primary rocker arm for each of said intake valves, each of said intake valve rocker arms being pivotally mounted about a common pivotal axis parallel to said intake cam shaft, said intake valve primary rocker arms being biased against said intake cam shaft;

an exhaust valve primary rocker arm for each of said exhaust valves, each of said exhaust valve primary rocker arms being pivotally mounted about a common pivotal axis parallel to the exhaust cam shaft, said exhaust valve primary rocker arms being biased against said exhaust cam shaft;

an intake valve secondary rocker arm for each of said intake valves, said intake valve secondary rocker arms being pivotally mounted about a common pivotal axis, being driven by said primary rocker arms and extending to said intake valves;

an exhaust valve secondary rocker arm for each of said exhaust valves, said exhaust valve secondary rocker arms being pivotally mounted about a common pivotal axis, being driven by said primary rocker arms and extending to said exhaust valves;

an intake mounting shaft for pivotally mounting both of said secondary rocker arms associated with said intake valves, said intake mounting shaft being centered between said intake valves; and an exhaust mounting shaft for pivotally mounting both of said secondary rocker arms associated with said exhaust valves, said exhaust mounting shaft being centered between said exhaust valves.

5. A valve assembly for an internal combustion engine as set forth in claim 1 wherein said mounting shaft extends outwardly and downwardly away from the axial centerline of the combustion chamber.

* * * * *